US011597570B1

(12) United States Patent
Heiniemi

(10) Patent No.: US 11,597,570 B1
(45) Date of Patent: Mar. 7, 2023

(54) HUMIDITY CONTROLLING CAP DEVICE

(71) Applicant: Jonathan Heiniemi, Nevada City, CA (US)

(72) Inventor: Jonathan Heiniemi, Nevada City, CA (US)

( * ) Notice: Subject to any disclaimer, the term of this patent is extended or adjusted under 35 U.S.C. 154(b) by 50 days.

(21) Appl. No.: 16/818,811

(22) Filed: Mar. 13, 2020

(51) Int. Cl.
*B65D 51/30* (2006.01)
*B65D 41/04* (2006.01)

(52) U.S. Cl.
CPC ..... *B65D 51/30* (2013.01); *B65D 41/04* (2013.01)

(58) Field of Classification Search
CPC ..... B65D 51/30; B65D 81/268
USPC ..... 206/204
See application file for complete search history.

(56) References Cited

U.S. PATENT DOCUMENTS 2,548,168 A * 4/1951 Luce ..... B65D 51/30 426/87
6,274,209 B1 * 8/2001 Pagidas ..... B65D 51/1616 206/204
10,081,465 B2 * 9/2018 Biesecker Longacre ..... B65D 81/22
2015/0203272 A1 * 7/2015 Versteylen ..... B32B 5/26 53/400

* cited by examiner

*Primary Examiner* — Rafael A Ortiz
(74) *Attorney, Agent, or Firm* — Theodore J. Bielen, Jr.

(57) ABSTRACT

A humidity controlling cap device utilizing a base member forming a recess and being detachable to a container. A carrier element having moisture regulating material lies in the recess and an air circulating cover encloses the carrier element within the recess.

2 Claims, 2 Drawing Sheets

HUMIDITY CONTROLLING CAP DEVICE

BACKGROUND OF THE INVENTION

The present application relates to a novel and useful humidity controlling cap device for use on a container. Control of humidity has been found to be important for use with stored items such as foodstuffs, tobacco products, jewelry, and other fine art items.

In the past, humidors have been devised to store cigars, cigarettes, cannabis, or pipe tobacco since it is important to maintain humidity at a steady level to prevent harm to such products. Certain humidors have been coupled with hygrometers in order to monitor the humidity level within the humidor case.

Reference is made to U.S. Pat. No. 5,936,178, which describes a humidity control device that employs a protective case in combination with a water vapor permeable pouch and a thickened saturated solution. The combination described in U.S. Pat. No. 5,936,178 is intended to maintain a steady level of humidity within the protective case. Although the apparatus of U.S. Pat. No. 5,936,289 successfully achieves this result, it is often necessary to control humidity in smaller and compact containers such as jars and tubes.

In accordance with the present application, a novel and useful humidity controlling cap is revealed which is capable of controlling the humidity level within a relatively small container.

SUMMARY OF THE INVENTION

The present application concerns a humidity controlling cap device for a container which may be employed to maintain the moisture level for smaller items such as tobacco products, candy and the like.

The humidity controlling cap device of the present application utilizes a base member that includes a first portion dimension to overlap the opening of the container compartment to which it is mated. The base member also includes a second portion which extends from the first portion and is fitted with a coupling for attaching the base member to the container. Such coupling may take the form of a threaded mechanism, a friction engaging mechanism, and the like. The first portion of the base member further includes a surface that is oriented to face the compartment of the container. In addition, the surface of the first portion of the base member includes a wall forming a recess.

A carrier element is also found in the device of the present application. The carrier element is formed with a plate and at least one aggregation of moisture regulating material placed adjacent to the plate. In certain cases, a plurality of aggregation of moisture regulating material may be connected to the plate. The carrier element is also configured to fit within the recess of the base member.

A cover is also utilized in the present application and includes a fastening surface that is capable of engaging the wall of the base member and is also capable of enclosing the recess of the base member. The cover includes a plurality of apertures providing communication between the container compartment and the recess of the base member. Each of the apertures are formed with a curved edge portion in order to induce a swirling or circular motion of the air or gas traveling from the container compartment to the recess and vice versa. The fastening surface of the cover may take the form of screw thread, which compliments a threaded surface on the wall portion of the base member.

Further, the plate of the carrier element may also be constructed with first and second surfaces that are opposite to one another. Moisture regulating material may be placed adjacent to the first and second surfaces of the plate such that both aggregations of moisture regulating material lie within the recess of the base member. Each of the aggregations of moisture regulating material may also be enclosed in a moisture pervious bag. The moisture regulating material may also take the form of a salt which is associated with water.

It may be apparent that a novel and useful humidity cap device has been described.

It is therefore an object of the present application to provide a humidity controlling cap device which is easily adapted for combination with existing cap structures and conventional jars or tubes.

Another object of the present application is to provide a humidity controlling cap device that includes a structure which insures adequate circulation of the air or gas within the connected container compartment holding a foodstuff or the like.

Another object of the present application is to provide a humidity controlling cap device which is compatible with prior art humidity controlling materials.

Another object of the present application is to provide a humidity controlling cap device which is structured to easily allow removal and replenishment of the humidity controlling material.

Yet another object of the present application is to provide a humidity controlling cap device which is relatively inexpensive to manufacture and is simple to use.

The application possesses other objects and advantages especially as concerns particular characteristics and features thereof which will become apparent as the specification continues.

Figure 1:
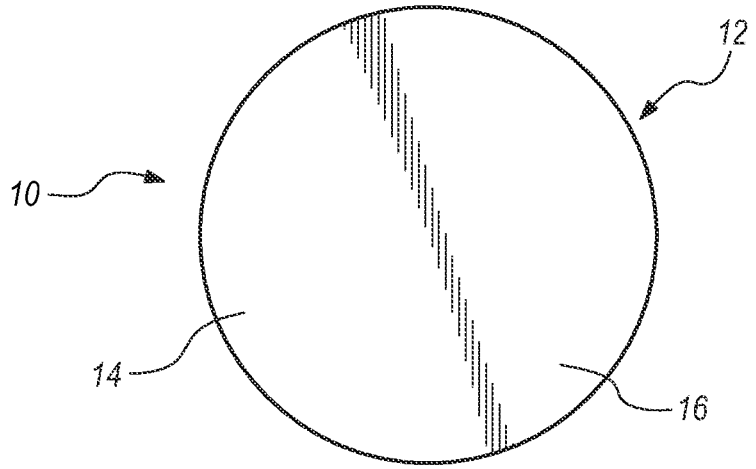
FIG. 1 is a top plan view of the device of the present application.

For a better understanding of the application, reference is made to the following detailed description of the preferred embodiments which should be taken in conjunction with the prior described drawings.

DETAILED DESCRIPTION OF THE PREFERRED EMBODIMENTS

Various aspects of the present application will evolve from the following detailed description of the preferred embodiments thereof which should be referenced to the prior delineated drawings.

The device of the present application as a whole is indicated by reference character 10. Device 10 is formed with a base member 12 which includes a first portion 14 having an outer surface 16. Base member 12 is also formed with a second portion 18, FIG. 2, that includes a coupling 20, depicted in FIG. 4 and partially shown in FIG. 2, for attaching base member 12 to a container 22, FIG. 3. As revealed in FIGS. 2 and 3, base member 12 is in the form of a conventional cap and engages a threaded top 24 of container 22. Thus, coupling 20 of base member 12 would be constructed as a complimentary thread for connection to the threaded surface of top 24 of container 22. Container 22 is also necessarily formed with a compartment 26 that holds stored items 28 such as tobacco, confectionaries, and the like. Such stored items 28 necessarily require a steady or constant humidity level. Moreover, base member is sized to overlap the opening 30 to container 22. Base member 12 also includes an inner surface 32 that is oriented to face compartment 28 of container 22 when base member is fitted to the threaded top of container 22. Further, base member 12 is also formed with a wall 34 which abuts inner surface 32 of base member 12, FIGS. 2, 4, and 5. Wall 34 serves to create a recess 36 in base member 12.

Figure 4:
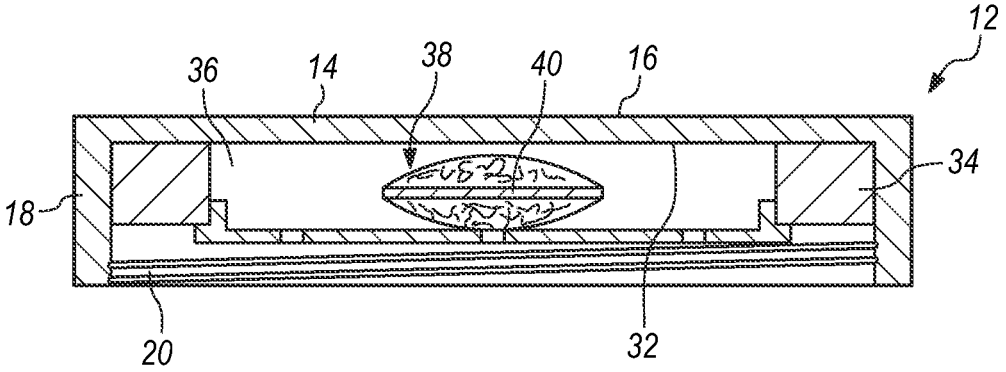
FIG. 4 is a sectional view taken along line 4-4 of FIG. 2.
Figure 5:
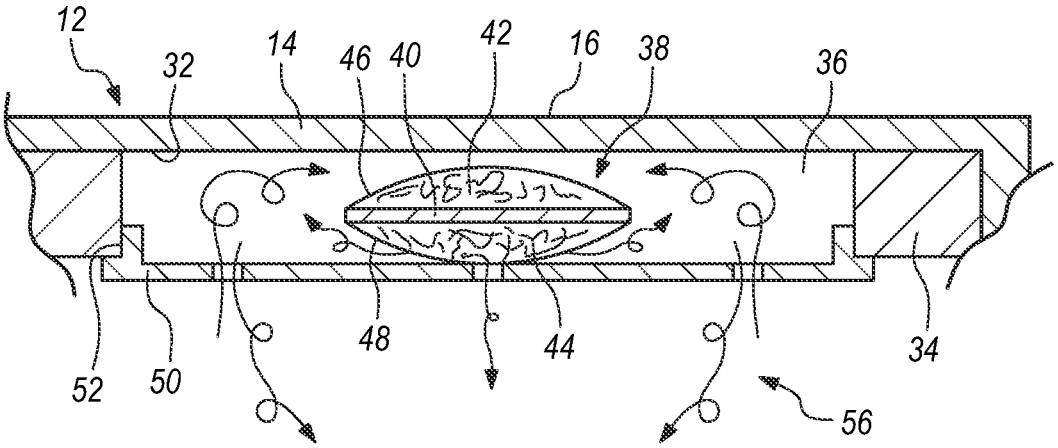
FIG. 5 is an enlarged view of FIG. 4 partially depicting the cover and the airflow pattern within and out from the recess formed by the base member.

Device 10 also entails a carrier element 38, best depicted in FIGS. 4 and 5. Carrier element 38 is constructed with a plate 40 that supports aggregations of moisture regulating material 42 and 44. Moisture pervious bags 46 and 48 enclose aggregations of moisture regulating material 42 and 44, respectively. Aggregations 42 and 44 of moisture regulating material may take the form of a salt associated with water, which is best described in U.S. Pat. No. 5,936,178.

Figure 2:
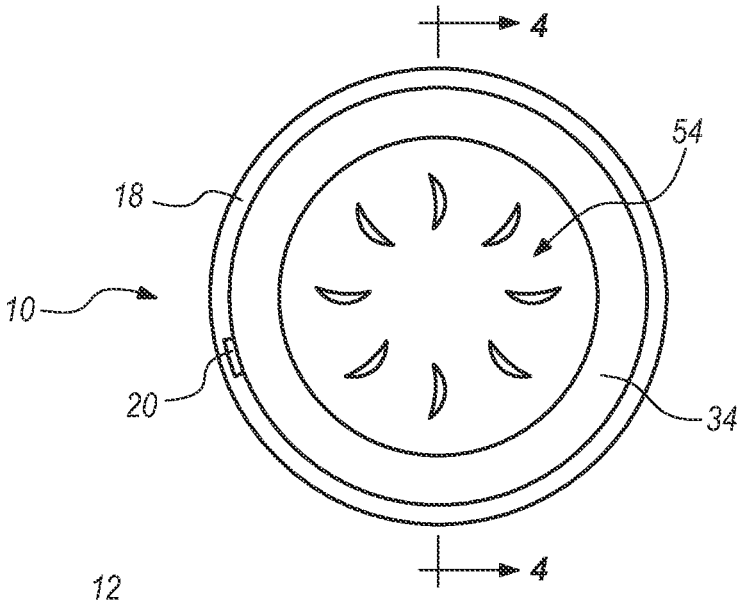
FIG. 2 is a bottom plan view of the device of the present application.
Figure 3:
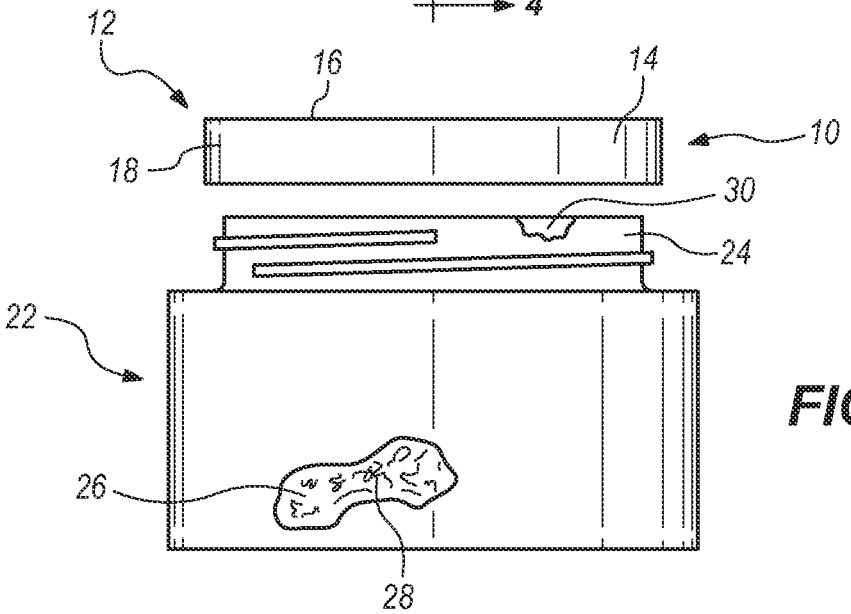
FIG. 3 is an exploded view indicating the employment of the device of the present application with a jar.

A cover 50 is also found in device 10 and is used to enclose recess 36 of base member 12. Cover 50 is provided with a fastening surface 52 such as a thread, depicted in FIG. 5. Cover 50 is also fashioned with a plurality of apertures 54 which provide communication between container compartment 28 and recess 36 of base member 12. Each of the plurality of apertures possesses a curved edge portion and is depicted in FIG. 2 as being crescent shaped. Plurality of apertures 54 induce the swirling, circular, or turbulent airflow between recess 36 and compartment 28 of container 22 when base member is fastened thereto. Swirling lines 56 of FIG. 5 illustrate such movement of air or gas between recess 36 and compartment 28. Thus, the moisture regulating quality of aggregations of moisture regulating material 42 and 44 acts upon the stored item 28 within compartment 26 of container 22 when base member 12 is fastened to threaded top of container 22, to maintain a level humidity environment.

In operation, the user places carrier element 38, having plate 40 holding aggregations of moisture regulating material 42 and 44, within recess 36 of base member 12. Cover 50 is then positioned over recess 36 to confine carrier element 38 within recess 36. Base member 12 is then fastened to threaded top 24 of container 22 with stored item 28 located within compartment 26 of container 22. The moisture regulating effect of carrier element 38 then takes place due to the plurality of apertures 54 found in cover 50 which is used to enclose recess 36. Cover 50 may be easily removed to replenish carrier element 38 as needed.

While in the foregoing embodiments of the application have been set forth in considerable detail for the purposes of making a complete disclosure of the application it may be apparent to those of skill in the art that numerous changes may be made in such details without departing from the spirit and principles of the application.

What is claimed is:

1. A humidity controlling cap device for a container including a compartment and an opening thereto comprising:

a base member, said base member possessing a first portion dimensioned to overlap the opening to the container compartment and a second portion extending from said first portion, said second portion of said base member including a coupling for attaching said base member to the container, said first portion of said base member further comprising a surface oriented to face the compartment of the container, said surface of said first portion of said base member further including wall forming a recess;

a carrier element, said carrier element including a plate, a first moisture pervious bag completely enclosing and containing an aggregation of moisture regulating material, said bag being placed against and supported by said plate;

a second moisture pervious bag completely enclosing and containing an aggregation of moisture regulating material, said bag being placed against and supported by said plate;

a cover, said cover including a fastening surface engaging said wall of said base member and being capable of enclosing said recess of said base member, said cover including plurality of apertures providing direct communication between the container compartment and said recess of said base member, each of said apertures being crescent shaped to induce turbulent airflow between said first and second moisture pervious bags in said recess of said base member and the compartment of the container to allow said moisture regulating material contained in said first and second bags to maintain a certain level of humidity in the container compartment.

2. The device of claim 1 in which said fastening surface of said cover comprises a screw thread.

* * * * *